US008186117B2

(12) United States Patent
Eren

(10) Patent No.: US 8,186,117 B2
(45) Date of Patent: May 29, 2012

(54) SYSTEM FOR CREATING A DECKING/FLOORING AND A METHOD FOR INSTALLING SAME

(76) Inventor: Tumer H. Eren, Woodbury, CT (US)

( * ) Notice: Subject to any disclaimer, the term of this patent is extended or adjusted under 35 U.S.C. 154(b) by 820 days.

(21) Appl. No.: 12/127,185

(22) Filed: May 27, 2008

(65) Prior Publication Data

US 2009/0293398 A1 Dec. 3, 2009

(51) Int. Cl.
*E04B 5/00* (2006.01)
*B32B 3/00* (2006.01)
*E01C 3/00* (2006.01)

(52) U.S. Cl. ..... 52/408; 52/403.1; 52/409; 52/411; 428/17; 428/150; 428/161; 428/331; 404/31

(58) Field of Classification Search ..... 52/408, 52/409, 411, 403.1, 515, 741.3, 741.4; 428/149, 428/150, 172, 331; 404/17, 19, 27, 31, 34–36
See application file for complete search history.

(56) References Cited

U.S. PATENT DOCUMENTS 1,721,861 A * 7/1929 Oden ..... 156/71
2,672,793 A * 3/1954 Rowe et al. ..... 404/31
2,861,525 A * 11/1958 Curtis ..... 52/309.14
3,345,246 A * 10/1967 Sheahan ..... 442/326
3,364,058 A * 1/1968 Wagner et al. ..... 428/213
3,466,222 A * 9/1969 Curtis ..... 428/142
3,561,334 A * 2/1971 Gerosa et al. ..... 404/75
3,725,185 A * 4/1973 Curtis ..... 442/27
3,763,614 A * 10/1973 Hyde et al. ..... 52/309.9
3,801,421 A * 4/1974 Allen et al. ..... 428/17
3,853,682 A 12/1974 Hurst
3,900,102 A * 8/1975 Hurst ..... 206/411
4,272,936 A * 6/1981 Bonaguidi ..... 52/309.12
4,392,335 A * 7/1983 Heiman ..... 52/309.17
4,393,634 A * 7/1983 McDermott et al. ..... 52/309.1
4,425,746 A * 1/1984 Bonaguidi ..... 52/309.12
4,430,463 A * 2/1984 Mullenax ..... 524/5
4,457,120 A * 7/1984 Takata ..... 52/309.4
4,474,833 A 10/1984 Maxfield
4,507,901 A * 4/1985 Carroll ..... 52/302.3
4,556,338 A * 12/1985 Fahey ..... 404/28

(Continued)

FOREIGN PATENT DOCUMENTS

JP 2005282128 A * 10/2005

OTHER PUBLICATIONS

"How do you get slip resistant concrete sealer?" on All-Things Concrete webpage (dated back to at least Apr. 5, 2007 on Wayback Machine at http://web.archive.org/web/20070405052652/http://www.all-things-concrete.com/slip-resistant-concrete-sealer.html; last accessed Feb. 10, 2011).*

(Continued)

*Primary Examiner* — Robert Canfield
*Assistant Examiner* — Charissa Ahmad
(74) *Attorney, Agent, or Firm* — Bachman & LaPointe, P.C.

(57) ABSTRACT

A decking/flooring system includes a substrate, a layer of sealing material applied over and in contact with a surface of the substrate, a texture layer applied over and in contact with the sealing material layer, an adhesive layer applied over and in contact with the texture layer, and a finish layer. A method for installing the decking/flooring system is also described.

14 Claims, 3 Drawing Sheets

U.S. PATENT DOCUMENTS

| | | | | |
|---|---|---|---|---|
| 4,719,723 | A * | 1/1988 | Van Wagoner | 52/15 |
| 5,137,764 | A * | 8/1992 | Doyle et al. | 428/44 |
| 5,253,461 | A * | 10/1993 | Janoski et al. | 52/408 |
| 5,348,784 | A * | 9/1994 | Lampert | 428/92 |
| 5,352,158 | A | 10/1994 | Brodeur, Jr. | |
| 5,362,342 | A * | 11/1994 | Murray et al. | 156/71 |
| 5,397,620 | A | 3/1995 | Hord, III | |
| 5,411,352 | A | 5/1995 | Eren | |
| 5,614,582 | A * | 3/1997 | Hori et al. | 524/507 |
| 5,766,754 | A * | 6/1998 | Fleck et al. | 428/323 |
| 5,816,014 | A * | 10/1998 | Tzeng et al. | 52/745.19 |
| 5,941,656 | A | 8/1999 | Sugiyama et al. | |
| 5,979,133 | A * | 11/1999 | Funkhouser | 52/408 |
| 6,192,650 | B1 * | 2/2001 | Kittson et al. | 52/741.4 |
| 6,200,638 | B1 | 3/2001 | Ordway | |
| 6,286,279 | B1 * | 9/2001 | Bean et al. | 52/390 |
| 6,444,258 | B1 | 9/2002 | Terry | |
| 6,576,577 | B1 * | 6/2003 | Garner | 442/374 |
| 6,586,066 | B1 * | 7/2003 | Buckwalter et al. | 428/40.1 |
| 6,599,599 | B1 * | 7/2003 | Buckwater et al. | 428/40.1 |
| 6,620,464 | B2 * | 9/2003 | Sciandra | 427/547 |
| 6,673,412 | B2 * | 1/2004 | Ramesh et al. | 428/77 |
| 6,769,215 | B1 * | 8/2004 | Carkner | 52/411 |
| 6,786,674 | B1 | 9/2004 | Hanks | |
| 6,877,288 | B2 * | 4/2005 | Shirota | 52/416 |
| 6,884,509 | B2 | 4/2005 | Huff et al. | |
| 6,913,785 | B2 | 7/2005 | Morton | |
| 7,004,673 | B2 | 2/2006 | Sapozhnikov | |
| 7,029,744 | B2 | 4/2006 | Horstman et al. | |
| 7,168,887 | B1 | 1/2007 | Rossi | |
| 7,261,490 | B2 * | 8/2007 | Allen et al. | 404/34 |
| 7,406,806 | B2 * | 8/2008 | Hallissy et al. | 52/481.1 |
| 7,625,625 | B2 * | 12/2009 | Rios et al. | 428/141 |
| 7,687,104 | B2 * | 3/2010 | Moon et al. | 427/136 |
| 2002/0081410 | A1 * | 6/2002 | Buckwalter et al. | 428/40.1 |
| 2003/0022011 | A1 * | 1/2003 | Sciandra | 428/546 |
| 2004/0253410 | A1 * | 12/2004 | Higgins et al. | 428/96 |
| 2005/0107499 | A1 * | 5/2005 | Georgeau et al. | 524/59 |
| 2006/0003652 | A1 * | 1/2006 | Faucher | 442/86 |
| 2006/0137272 | A1 * | 6/2006 | Kim | 52/411 |
| 2006/0191223 | A1 * | 8/2006 | Bontrager, II | 52/411 |
| 2006/0205869 | A1 * | 9/2006 | Steidl et al. | 524/591 |
| 2007/0199251 | A1 * | 8/2007 | Sieling et al. | 52/58 |
| 2007/0218251 | A1 * | 9/2007 | Jacobs et al. | 428/143 |
| 2008/0104917 | A1 * | 5/2008 | Whelan et al. | 52/408 |
| 2008/0115444 | A1 * | 5/2008 | Kalkanoglu et al. | 52/518 |
| 2008/0118640 | A1 * | 5/2008 | Kalkanoglu et al. | 427/186 |
| 2008/0213529 | A1 * | 9/2008 | Gray et al. | 428/44 |
| 2009/0064618 | A1 * | 3/2009 | Ben-Daat et al. | 52/408 |
| 2009/0178355 | A1 * | 7/2009 | Pugh et al. | 52/408 |

OTHER PUBLICATIONS

"Floor Surfacing" from Smith and Company webpage (dated back to Dec. 31, 2006 on Wayback Machine at http://web.archive.org/web/20061231123839/http://www.smithandcompany.org/FlorSurf.html; last accessed Feb. 11, 2011).*

* cited by examiner

SYSTEM FOR CREATING A DECKING/FLOORING AND A METHOD FOR INSTALLING SAME

BACKGROUND (1) Field of the Invention

The present invention relates to a system for creating a decking/flooring and to a method for installing same.

(2) Prior Art

Concrete deck slabs, such as those used in parking garages, expand and contract with changes in temperature. They also experience significant flexing due to constant changes in the weight of vehicular loads. These conditions almost always result in leaks; which allow water, salt, and other traffic related chemicals to deteriorate concrete and steel reinforcements under the deck. Prior sealing systems wee either not elastic enough to expand and contract with the concrete or not tough enough to hold up to the vehicular traffic, usually resulting in the return of leaks in just a few years.

Rooftop decks suffer from a number of problems resulting from their exposure to environmental elements and from use as recreational, athletic and/or other pedestrian facilities. They too suffer from leaks which allow water and other chemicals to deteriorate concrete and/or steel reinforcements under the deck.

Moisture and water vapor can create a serious concern with below-grade flooring applications. The moisture and water vapor can lead to cracking, swelling, delaminating, and subsurface movement.

Facilities such as locker rooms, aerobic studios, manufactured areas, weight rooms, and high traffic corridors all have floors which may be subject to cracking and/or delamination as a result of everyday use.

Replacing concrete deck slabs, roof decks, and flooring can be very expensive. It is desirable to provide an underlayment system which helps increase the life of the structure that it will support.

SUMMARY OF THE INVENTION

Accordingly, it is an object of the present invention to provide a system for creating a decking/flooring which waterproofs, repairs, and protects substrates including, but not limited to, concrete, asphalt, wood, and steel from the effects of moisture, salt, environmental contaminants, and other chemicals.

In accordance with the present invention, a decking/flooring system broadly comprises a substrate, a layer of sealing material applied over and in contact with a surface of said substrate, a texture layer applied over and in contact with said sealing material layer, an adhesive layer applied over and in contact with said texture layer, and a finish layer.

It is a further object of the present invention to provide a method for installing a decking/flooring.

In accordance with the present invention, a method for installing a decking/flooring system broadly comprises the steps of installing at least one support structure, such as at least one T-beam or a structural concrete slab, in proximity to a structure, installing a substrate over said at least one beam structure, installing an expansion joint between an edge of said substrate and said structure, applying a layer of sealing material over and in contact with a surface of said substrate, applying a texture layer over and in contact with said sealing material layer, applying an adhesive layer over and in contact with said texture layer; and installing a finish layer.

Other details of the system and the method for installing same of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
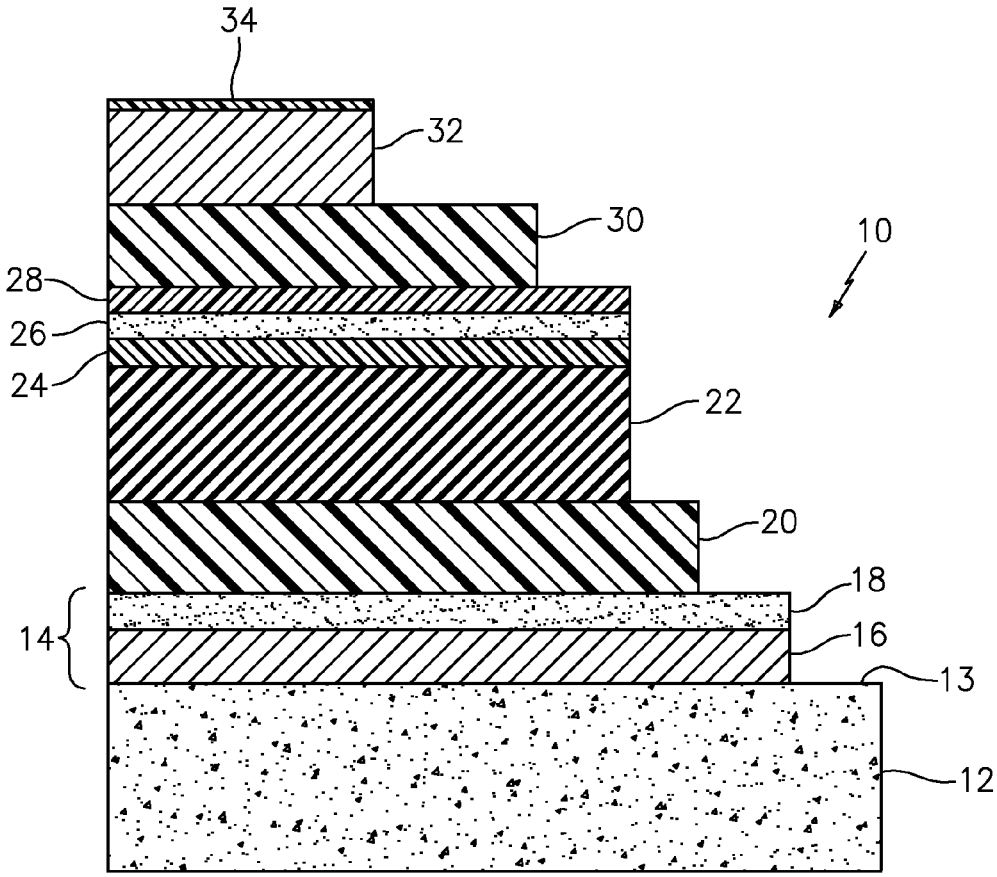
FIG. 1 is a cross sectional view of a first embodiment of a system in accordance with the present invention.

Referring to FIG. 1, there is shown a system 10 for creating a decking/flooring in accordance with one embodiment of the present invention. The system 10 includes a substrate 12 to be protected, such as a layer of concrete, for example a fiber reinforced concrete. As can be seen from this figure, the system 10 includes a layer 14 of sealing material on top of the substrate 12. The sealing material may be a concrete sealer layer 16 with a texture layer 18. The sealing material in the layer 16 may be applied to the surface 13 of the substrate 12 with a steel blade or a roller. It may have a thickness in the range of 1.0 to 100 mils. The texture layer 18 may be a layer of 40-60 mesh clean silica sand. It should be applied over the layer 16 while the layer 16 is wet. The total thickness of the layer 14 may be in the range of 2.0 mils to 200 mils.

The system 10 further comprises a layer 20 of moisture cured stabilizer/adhesive on top of the sealing material layer 14. The stabilizer/adhesive may be a breathable polyurethane material. It may be applied using a thick metal blade after any loose silica sand is removed. The layer 20 may have a thickness in the range of from 75 to 100 mils.

A layer 22 of a pre-fabricated waterproof membrane material may be applied over the layer 20. The pre-fabricated waterproof membrane material may be a 6.0 to 8.0 mm thick pre-fabricated, roll or tile form SBR rubber having a density of 40-50 lbs./cu. ft. The layer 22 provides a barrier to water and other fluids.

Over the layer 22, there may be a primer/adhesive layer 24, a texture layer 26, and a layer 28 of a leveling compound. Usually, the layer 22 comes with the primer/adhesive layer 24 and the texture layer 26 as a single unit; however, the layers 22, 24, and 26 could be separately installed layers if desired. The primer/adhesive layer 24 may comprise a moisture cured polyurethane material having a thickness of 1.0 to 150 mils. The texture layer 26 may be a layer of 40-60 mesh silica sand. The layer 28 is separately installed over the texture layer 26. The layer 28 may be formed from an acrylic polymer and may be applied using a soft rubber squeegee. The layer 28 may have a thickness of about 200 mils.

On top of the leveling compound layer 28, there may be another layer 30 of an adhesive/stabilizer material. The layer 30 may be formed from a moisture cured breathable polyurethane adhesive having a thickness of 1.0 to 120 mils. The layer 30 may be applied using a steel blade.

Finally, the system 10 may include a finish layer 32 for forming a finishing surface. The finish layer 32 may be brick, hardwood flooring, concrete, or any other suitable finishing material. Alternatively, the finish layer 32 may be an ultrahigh abrasion resistant coating such as MgO, marble, brick pavers, slate, tile, colored quartz, granite aggregate, color coated silica sand chips, etc.

If desired, a layer 34 of a sealer may be applied over the finish layer 32. The sealer may be applied over materials such as diamond (MgO, Fe2O3, SiO2), colored quartz, marble or granite aggregate. The sealer may be a breathable, polyurethane sealer and have a thickness of approximately 60 mils.

The system 10 produces a resilient protective surface that can withstand the ravages of vehicular or pedestrian traffic, while being elastic enough to absorb the natural expansion and contraction of concrete or other substrates. Still further, the system 10 provides sound deafening properties, as well as a warmer, softer, and overall more comfortable feel.

The system 10 is able to expand and contract more than 1% (as much as 1" in 10'), so that the constant movement and flexing of the subsurface (concrete, wood, asphalt, etc.) cannot break the integrity of the monolithic seal. The system is impermeable to water or other fluids and retains no water or solvent, the sub-surface remains totally protected from oxidation or other chemical reactions, which would result in cracking, peeling, flaking, or other deterioration. Although the system 10 is impermeable to water, it has been designed to be permeable to the normal gaseous emissions of aging concrete such as water vapor. This means that the system will not bubble or delaminate as is common with standard concrete sealing materials.

Figure 2:
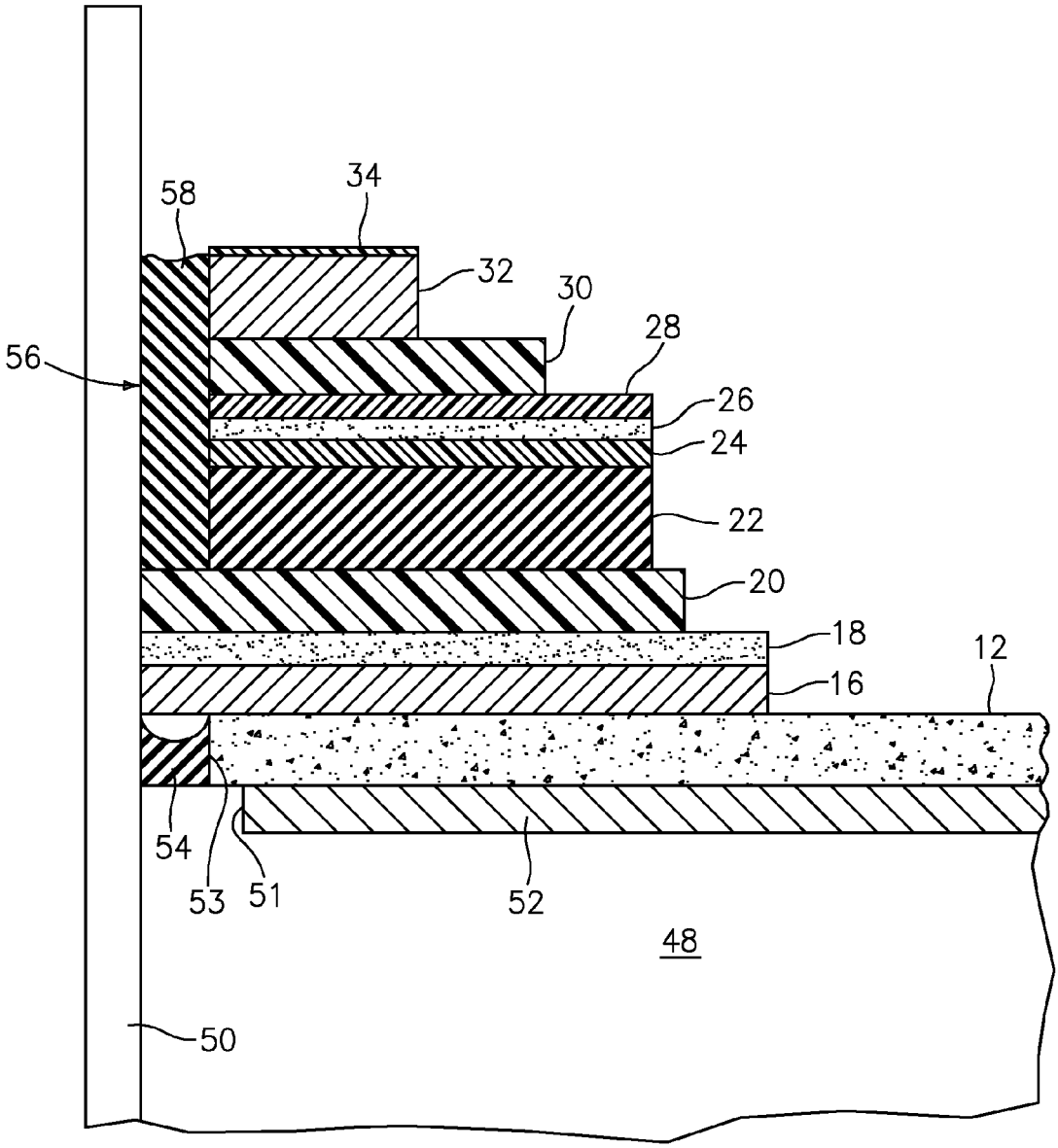
FIG. 2 is a cross sectional view of an installation of the system of FIG. 1.

Referring now to FIG. 2, there is shown a technique for installing the system 10. As can be seen from this figure, the system 10 may be installed against a structure 50 such as a vertical wall, a step, etc. One or more structural supports 52, such as at least one concrete slab or at least one T-Beam, may be positioned in an appropriate location on a support surface 48. The structural support(s) 52 may be formed from concrete, a metal base material, or a wood base material and preferably have an edge 51 spaced from the structure 50. The substrate 12 may be installed using any suitable technique known in the art. If the substrate 12 is topping concrete, then the concrete should cure for a suitable period such as 21 days. After curing, the uppermost surface of the substrate 12 may be ground to achieve a smooth finish and to remove all sharp projections. Any defects in the surface should also be repaired. Also, any contaminants, such as oil, grease, etc., that would impair bonding should be removed. An expansion joint 54 is installed between an edge 53 of the substrate 12 and the structure 50. The expansion joint 54 may be formed from any suitable material such as a sealant or caulk.

After the substrate 12 has been prepared, the layer 14 of sealing material may be applied using any suitable technique known in the art. As noted above, the sealing material layer 14 may include a layer of sealing material 16 and a texture layer 18.

After the sealing layer 14 has been installed, the layer 20 of a stabilizer/adhesive material may be applied using any suitable technique known in the art. Thereafter, the layer 22 of the pre-fabricated waterproof membrane material may be applied over the layer 20. The membrane material should be free of wrinkles, blisters, fishmouths, and any other defects which would impair the waterproofing qualities of the membrane. After the layer 22 is installed, it should be rolled to insure full contact with the adhesive/stabilizer layer 20. The layer 22 may consist of one or more layers of the waterproof membrane material.

Thereafter, the layer 24 of the primer/adhesive material, the texture layer 26, and the layer 28 of leveling compound may be applied, again using any suitable technique known in the art. Before, the primer layer 24 is applied, the membrane layer 22 should be vacuumed to remove all dust and all dirt and debris should be removed from the membrane.

Thereafter, another layer 30 of a stabilizer/adhesive material is applied using any suitable technique known in the art. Finally, a layer 32 of a finishing material is applied. If needed, a sealer may be applied over the layer 32.

As can be seen from FIG. 2, the layers 22, 24, 26, 28, 30, and 32 have an edge closest to the structure 50 which is spaced from the structure 50. The space 56 between the edges and the structure 50 may be filled with a suitable wide joint sealant or caulking material 58. Any suitable material known in the art may be utilized.

Figure 3:
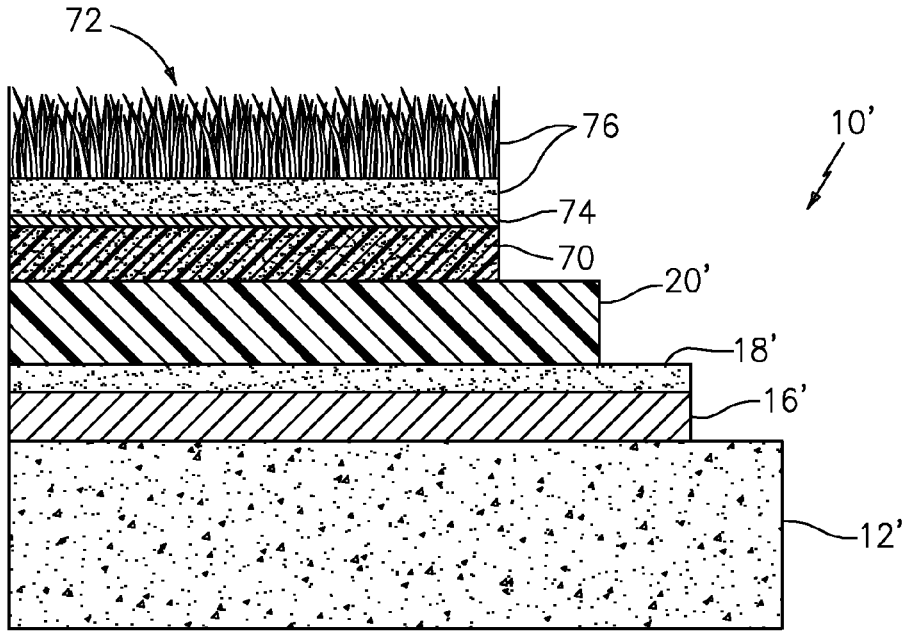
FIG. 3 is a cross sectional view of a second embodiment of a system in accordance with the present invention.

FIG. 3 illustrates a system 10' for installing artificial grass in accordance with the present invention. The system 10' includes a substrate layer 12', such as at least one T-beam, a structural concrete slab, or topping concrete layer, a layer 16' of a concrete sealer over the substrate layer 12', a texture layer 18' over the layer of concrete sealer, and a layer 20' of stabilizer/adhesive material. Over the layer 20', a foam/shock pad 70 may be applied. The pad 70 may be formed from any suitable material known in the art. Thereafter, a layer 72 of artificial grass may be installed. The layer 72 preferably has a composite back layer 74. The grass portion 76 of the layer 72 may be 10,000 Denier monofilament and 4200/8 ply monofilament spring-set nylon. The layers 72 and 74 may be separate layers or the pad 70 may include both the layers 72 and 74 in a pre-assembled condition.

Figure 4:
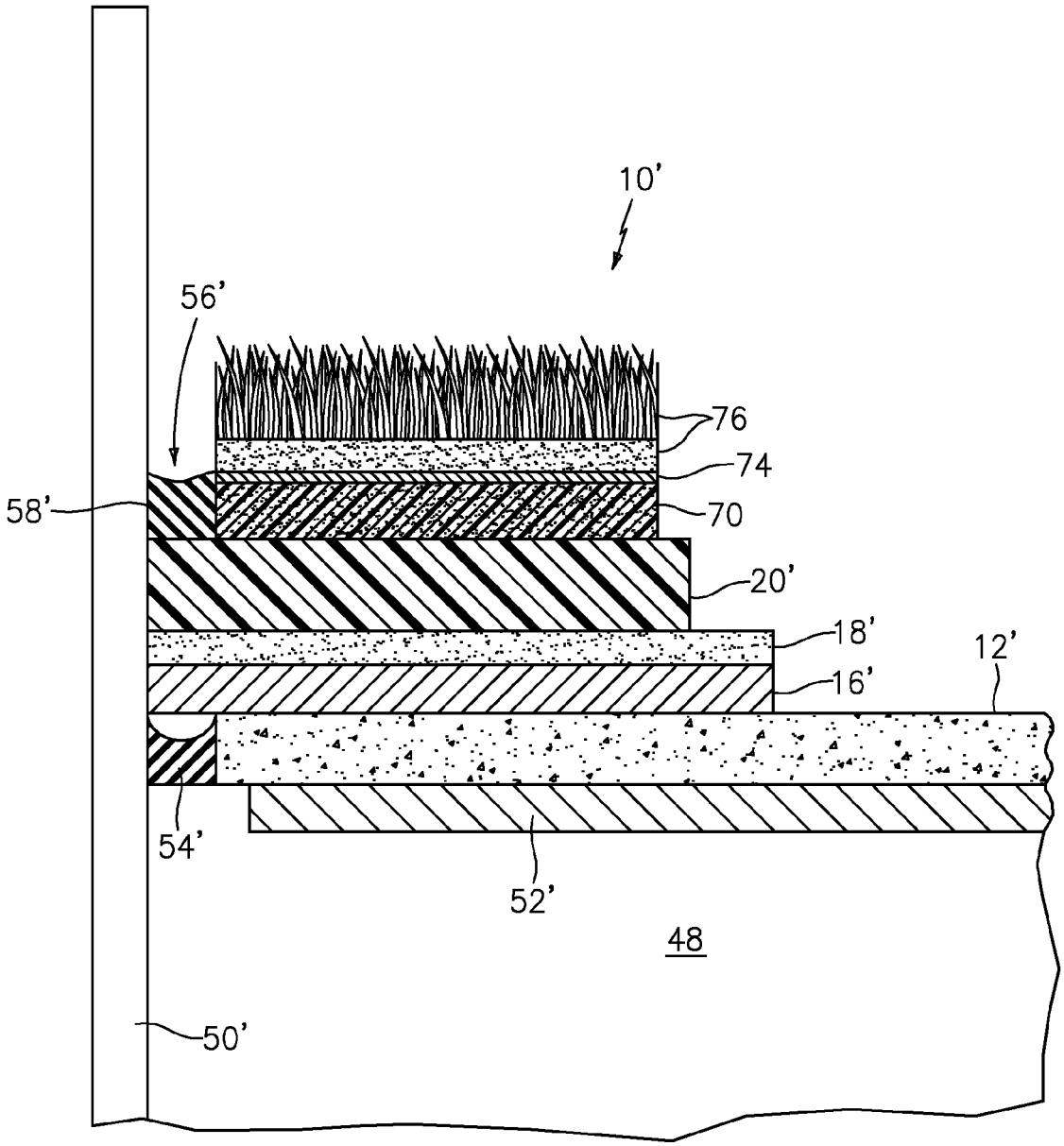
FIG. 4 is a cross sectional view of an installation of the system of FIG. 3.

FIG. 4 illustrates one technique for installing the artificial grass against a structure 50' such as a vertical wall or a step. As before, one or more structural supports 52', such as one or more concrete slabs or T-Beams, are installed. Thereafter, the substrate 12' is installed with an edge of the substrate 12' being spaced from the structure 50'. An expansion joint 54' is installed between the edge of the substrate 12' and the structure 50'. The joint 54' may be formed from any suitable sealant or caulking. Thereafter, the layer 16' of sealing material and the layer 18' of texture material are installed using any suitable technique known in the art. A layer 20' of stabilizing/adhesive material is then installed over the layer 18'. Thereafter, the pad 70 and the layer 72 of artificial grass are installed. As can be seen from the figure, an edge of the pad 70 and the layer 72 is spaced from the structure 50' so as to create a space 56'. The space 56' is then filled with a sealing material 58' such as a wide joint sealant/caulking material.

The sealing material used for the layers 14 and 14' may have a solids content of 83%, a viscosity of 4500 centipoise, a pot life of 30 minutes, a tack-free time of from 1 to 2 hours, a cure time/traffic of 24 hours, and a cure time/chemical exposure of 7 hours. The cured sealing material preferably has an elongation of 250%, a tensile strength of 2900 psi, a permanent set at break of 10%, a tear resistance of 235 phi, a hardness of 95 Shore A, an abrasion resistance of 3 mg loss, an adhesion to peel of 67 phi dry/32 wet, a water absorption of 1.6%, a volume solids of 83%, weight per gallon of 9.7 lbs, a flashpoint of 75.2 degrees, a class I flame spread rating, a MVT rate at full system of 2.0 perm and cyclical movement of 1000 cycles.

The stabilizer/adhesive and primer/adhesive materials used in the systems 10 and 10' are preferably formed from a polyurethane material which has a viscosity of 800-1200 centipoise, a working time of 20-30 minutes, a solids content of from 93-97%, a specific gravity in the range of 1.15 to 1.35, a tensile strength of 1200-1600 psi, an elongation of from 40 to 60%, an unlimited number of freeze/thaw cycles, an application temperature in the range of 40 to 120 degrees Fahrenheit, a weight of 9.5 to 11.5 lbs per gallon, a coverage of 75-100 square foot per gallon, and adhesion to a subsurface of 4000 psi.

The waterproof membrane used for the layer 22 in the system 10 preferably has a thickness in the range of 6-8 mm, a minimum density of 45 lbs/cu. Ft., a minimum tensile strength of 55 psi, a durometer of 40 to 60, and a minimum elongation of 75%. The membrane may be formed from an SBR Rubber (styrene-butadiene rubber).

The artificial grass layer 72 used in the system 10' may be formed from a mono-polyethylene fiber and a monofilament nylon such as 10,000 Denier Monofilament Polyethylene and 4200/8 ply monofilament spring-set nylon. The material forming the layer 72 may have a ⅜ inch gauge, a stitch rate in the range of 15.5 to 16.5 stitches per 3 inches, a pile height of 0.875 to 1.125 inches polyethylene, a face weight of 48 ounces, a primary backing formed from an 8 ounce composite back and a secondary backing of 20 oz urethane or 5 mm foam, a width of 6-12 feet, and a shipping weight of 9 lbs per linear foot. One such artificial grass material is Fast Grass 275 manufactured by Evergreen Synthetic Turf LLC.

The system 10 of the present invention may be used to repair and protect concrete, wood, steel, and other substrates from the effects of moisture, salt, environmental contaminants and other chemicals. The system 10 of the present invention may be used to create parking garage decks, roof decks, basement floors, resilient floors, and other types of floors.

It is apparent that there has been provided in accordance with the present invention a system for creating decking/flooring and a method for installing same which fully satisfies the objects, means, and advantages set forth hereinbefore. While the present invention has been described in the context of specific embodiments thereof, other unforeseeable variations, modifications, and alternatives may become apparent to those skilled in the art having read the foregoing detailed description. Accordingly, it is intended to embrace those alternatives, modifications, and variations as fall within the broad scope of the appended claims.

What is claimed is:

1. A decking/flooring system comprising:

a substrate formed from concrete;

a layer of sealing material applied over and in contact with a surface of said substrate;

a texture layer applied over and in contact with said sealing material layer;

an adhesive layer applied over and in contact with said texture layer;

said adhesive layer being formed from a polyurethane material;

at least one layer of a pre-fabricated waterproof membrane material in contact with said adhesive layer;

a primer/adhesive layer applied to a surface of said membrane material and an additional texture layer applied to a surface of said primer/adhesive layer;

each texture layer being formed from silica sand; and a finish layer.

2. The decking/flooring system of claim 1, further comprising:

a layer of padding in contact with a surface of said adhesive layer; and said finish layer being an artificial grass layer in contact with said padding layer.

3. The decking/flooring system of claim 2, wherein said artificial grass layer has a composite backing and is formed from a mono-polyethylene fiber and a monofilament nylon.

4. The decking/flooring system of claim 3, wherein said artificial grass layer comprises a 10,000 denier monofilament polyethylene and a 4200/8 ply monofilament spring set nylon.

5. The decking/flooring system of claim 1, wherein said membrane material comprises an SBR rubber material having a thickness of 3 to 6 mm., a minimum density of 45 lbs/cu. ft., a minimum tensile strength of 55 psi, a durometer of 40 to 60, and an elongation of at least 75%.

6. The decking/flooring system of claim 1, further comprising a layer of leveling compound applied over said texture layer.

7. The decking/flooring system of claim 6, wherein said leveling compound is an acrylic polymer.

8. The decking/flooring system of claim 6, further comprising an additional adhesive layer applied over said leveling compound layer.

9. The decking/flooring system of claim 8, wherein said additional adhesive layer and said primer/adhesive layer are formed from a polyurethane material.

10. The decking/flooring system of claim 9, wherein said polyurethane material has a viscosity of 800-1200 centipoise, a tensile strength of 1200 to 1600 psi, an elongation of 40 to 60%, a specific gravity of 1.15 to 1.35, a solids content of 93-97%, a weight of 9.5 to 11.5 lbs per gallon, and a coverage of 75 to 100 square foot per gallon.

11. The decking/flooring system of claim 1, wherein said finish layer comprises at least one material selected from the group consisting of brick, hardwood flooring, asphalt, concrete, MgO, marble, brick pavers, slate, and tile.

12. The decking/flooring system of claim 1, further comprising a layer of a sealer material applied over said finish layer.

13. The decking/flooring system of claim 1, wherein said sealer material comprises a polyurethane material.

14. A decking/flooring system comprising:

a substrate;

a layer of sealing material applied over and in contact with a surface of said substrate;

a texture layer applied over and in contact with said sealing material layer;

an adhesive layer applied over and in contact with said texture layer;

at least one layer of a pre-fabricated waterproof membrane material in contact with said adhesive layer;

a primer/adhesive layer applied to a surface of said membrane material and an additional texture layer applied to a surface of said primer/adhesive layer;

each texture layer being formed from silica sand;

a finish layer; and a layer of sealer material applied over said finish layer.

* * * * *